US005599052A

United States Patent [19]

Van Davelaar

[11] Patent Number: 5,599,052

[45] Date of Patent: Feb. 4, 1997

[54] BAG CARRIER WITH MEANS FOR PROMOTIONAL INDICIA AND/OR CUSTOMER IDENTIFICATION

[76] Inventor: Peter C. Van Davelaar, 14505 Standing Oak Ct., Midlothian, Va. 23112

[21] Appl. No.: 357,718

[22] Filed: Dec. 16, 1994

[51] Int. Cl.[6] ..... B65D 33/06

[52] U.S. Cl. ..... 294/159; 294/142; 294/170; 283/75

[58] Field of Search ..... 294/137, 141–143, 294/158, 159, 170, 171; 383/11, 13, 14, 25; D9/434; 248/205.3, 206.5; 283/45, 75, 904; 40/299, 328, 630

[56] References Cited

U.S. PATENT DOCUMENTS

| | | | |
|---|---|---|---|
| D. 137,712 | 4/1944 | Miano | 294/170 |
| D. 290,935 | 7/1987 | Williams | D9/434 |
| D. 294,127 | 2/1988 | Chmela | D9/434 |
| D. 294,559 | 3/1988 | Schwalbach | D9/434 |
| D. 294,915 | 3/1988 | Alonso | D9/434 |
| D. 295,727 | 5/1988 | Clarke | D9/434 |
| D. 314,150 | 1/1991 | Preciutti | D9/455 |
| D. 325,169 | 4/1992 | Montoya | D9/434 |
| D. 327,846 | 7/1992 | Jacobs | D9/434 |
| D. 328,187 | 7/1992 | Saurette | D3/54 |
| D. 336,732 | 6/1993 | Joyner | D8/434 |
| D. 337,053 | 7/1993 | Oden | D9/434 |
| D. 340,863 | 11/1993 | Daigle | 294/159 |
| D. 361,935 | 9/1995 | Johnson | D9/434 |
| 1,498,247 | 6/1924 | Stewart | 294/159 |
| 2,506,781 | 5/1950 | Elliott | 224/57 |
| 2,519,186 | 8/1950 | Herbert et al. | 16/114 |
| 2,528,239 | 10/1950 | McVay | 224/56 |
| 2,717,411 | 9/1955 | Taipale | 16/114 |
| 2,800,940 | 7/1957 | Riesebeck | 150/12 |
| 2,977,082 | 3/1961 | Harris | 248/206.5 |
| 3,083,366 | 3/1963 | Franges | 16/114 |
| 3,149,367 | 9/1964 | Dills | 16/110 |
| 3,207,397 | 9/1965 | Wilson | 224/45 |
| 3,302,837 | 2/1967 | Montgomery | 294/159 |
| 3,306,507 | 2/1967 | Wilson | 224/45 |
| 3,657,765 | 4/1972 | Gelsinger | 16/114 B |
| 3,680,752 | 8/1972 | Wilson | 224/56 |
| 3,800,361 | 4/1974 | Stauffer | 16/116 |
| 3,912,140 | 10/1975 | Franges | 224/45 P |
| 3,913,172 | 10/1975 | Richards et al. | 16/114 B |
| 4,004,722 | 1/1977 | Olivier | 224/45 P |
| 4,112,541 | 9/1978 | Tetradis | 16/114 R |
| 4,262,385 | 4/1981 | Norman | 16/114 R |
| 4,271,352 | 6/1981 | Thomas | 283/75 |
| 4,417,413 | 11/1983 | Hoppe et al. | 40/630 |
| 4,590,640 | 5/1986 | Enersen | 16/114 B |
| 4,772,059 | 9/1988 | Parry et al. | 294/170 |
| 4,841,596 | 6/1989 | Fink | 16/114 B |
| 4,890,355 | 1/1990 | Schulten | 16/111 R |
| 4,902,060 | 2/1990 | Nobakht | 294/171 |
| 4,923,235 | 5/1990 | Stewart | 294/141 |

(List continued on next page.)

FOREIGN PATENT DOCUMENTS

| | | | |
|---|---|---|---|
| 81/03008 | 10/1981 | WIPO | 383/13 |

*Primary Examiner*—Dean Kramer
*Attorney, Agent, or Firm*—Auzville Jackson, Jr.

[57] ABSTRACT

An improved bag carrier for carrying bags or parcels having one or more loops or handles. The bag carrier is of essentially flat design to allow for inexpensive manufacturing and distribution, as well as providing space for advertising indicia and customer identification information. The bag carrier is comprised of a horizontal upper handle section 26 (FIG. 1) connected to a horizontal lower hook support section 30 (FIG. 1) by connecting vertical members 28 and 29 (FIG. 1). A plurality of hook bases 31 (FIG. 1) and hook sections 32 (FIG. 1) extend down from horizontal lower hook support section 30 (FIG. 1). Areas are included on the surface of the carrier which are unlikely to be handled or rubbed excessively during use, allowing for preservation of important indicia, such as bar codes and magnetic strips. Multiple hooks on the bag carrier allow for bags to be attached or removed from the carrier one at a time without tangling. An attaching device is included on the carrier for storing it on vertical surfaces, such as refrigerator doors.

15 Claims, 6 Drawing Sheets

U.S. PATENT DOCUMENTS

| | | | |
|---|---|---|---|
| 4,936,619 | 6/1990 | Salazar | 294/171 |
| 4,946,065 | 8/1990 | Goulter et al. | 220/404 |
| 5,005,891 | 4/1991 | Lunsford | 294/171 |
| 5,029,926 | 7/1991 | Dieterich, Jr. | 294/171 |
| 5,060,998 | 10/1991 | Phillips | 294/146 |
| 5,083,825 | 1/1992 | Bystrom et al. | 294/171 |
| 5,102,003 | 4/1992 | Oswald et al. | 248/206.5 |
| 5,150,938 | 9/1992 | Gans | 294/156 |
| 5,181,757 | 1/1993 | Montoya | 294/159 |
| 5,199,758 | 4/1993 | Howell | 294/171 |
| 5,368,393 | 11/1994 | Normann | 294/170 |

BAG CARRIER WITH MEANS FOR PROMOTIONAL INDICIA AND/OR CUSTOMER IDENTIFICATION

Background—Cross-References to Related Applications

A related application entitled "Non-card based system for customer identification and tracking" should be filed in the near future.

BACKGROUND—FIELD OF INVENTION

The invention relates to customer identification cards and carriers for carrying bags or parcels with one or more loop handles, said carriers also accommodating promotional indicia and/or computer readable customer identification means and proof of identification means.

BACKGROUND—DISCUSSION OF PRIOR ART

Since no prior art could be located for a combination bag carrier and customer identification card, the prior art of the two items are discussed separately below.

Bag Carrier:

Bags with handles are becoming increasingly common in the marketplace. In addition to paper bags with twine or tubular plastic handles, there are plastic bags with handles formed from the same material as the bags themselves. When heavily loaded, the handles of the plastic bags become taut and more likened to a string or wire which cuts across the hand and fingers of the person carrying the bags, which can become painful after a short period of time. Often, this discomfort limits the amount a person can carry to far below their normal strength limits.

There are bag carriers designed to carry bags with handles, but none have been created with the proper combination of features to insure a useful product.

Patents on such carriers appear to be addressing the wrong areas. While comfort is an important consideration, cost, advertising, and ease of use have not been given proper consideration in patented designs thus far seen. Many of the patents stress comfort and bag retention excessively.

Comfort is typically achieved by having a large, contoured contact area between the device and the fingers of the person carrying the load. Bag retention is typically achieved by passing the bag handles through restricted sections of the carrier, or utilizing a secondary locking device to keep the bag handles from slipping out of the carrier when the carrier is set down.

While both these qualities are desirable, there are other desirable qualities which are excessively impacted by the previous designs. While comfort is important to a degree, an excessively wide user contact area will add cost in extra material, more complex molds, and increased cycle times, as well as increasing weight and size of the carrier. Since most people are limited by strength and endurance in how much weight they can carry over a given distance, excessive cushioning simply causes them to reach other limits in their package carrying ability, while making the bag carrier more expensive and cumbersome.

Using restricted openings or secondary locking devices to keep bag handles in the carrier adversely effects both ease of use and cost. Restricted openings may not work with twine handles. For the restriction to serve any function, it must impede the release of the handles by the carrier. This would make it difficult to unload the grocery bags from the carrier one bag at a time. The restrictions illustrated in previous patents were mostly nondirectional, so they also make it difficult to connect the bag handles to the carrier. Secondary locking devices need extra parts or tighter tolerances, thereby raising costs. The problem of bag handles coming out of the carrier in a properly designed carrier is too minimal to warrant the added cost and inconvenience of the methods previously employed to hold them in.

Additionally, the inventors of all previous designs which involved a molded part followed the natural tendency to put the web in the middle of the part, as seen in U.S. Pat. No. 5,181,757 issued Jan. 26, 1993 to Arturo T. Montoya, U.S. Pat. No. Des. 336,732 issued Jun. 22, 1993 to Ken Joyner, U.S. Pat. No. Des. 294,559 issued Mar. 8, 1988 to Richard I. Schwalbach, and U.S. Pat. No. 4,772,059 issued Sep. 20, 1988 to Bernard Parry. This is not the best solution for two reasons: First, it makes it difficult to add printed matter, whether thru silk screening, labels, decals, or other methods, since the surface to be marked is no longer the highest surface. Secondly, it makes the mold more complicated and expensive than necessary. By placing the web flush with one side of the part, and making that entire side of the part flush, It is possible for one half of the mold to be essentially a flat plate, with no intricate machining.

While several patents, (U.S. Pat. No. 4,946,065 issued Aug. 7, 1990 to Victor H. Goulter, U.S. Pat. No. Des. 337,053 issued Jul. 6, 1993 to Michael R. Oden), have claimed the room for logos, etc, the designs do not allow for easy application of indicia.

Another area not addressed by previous patents, is how and where to store the carrier when it is not needed, so it will be readily available when it is needed.

Many of the prior art patents involve carriers which cushion bag handles, whereby bag handles still run above the fingers of the user, with the carrier isolating the bags handles from the user. A general disadvantage of this concept is that all bag handles are grouped together, making it difficult to separate them so bags can be set down individually.

The most common disadvantages of prior art units are as follows, none of the previous units resolve all these problems:

Units could interlock when placed randomly in bins, which affects ease of production automation and final cost of unit.

Difficult to apply printed indicia or labels.

Cumbersome to use.

Unit would tangle easily with purse contents.

Mold tooling would be expensive.

Mold tooling may require inserts.

Too many parts to remain an inexpensive option.

Shape awkward to carry in pocket or purse

Additionally, the ability to add personal information in a computer recognizable format has not been addressed by any of the previous art.

Also, proof of identification, as in the form of a signature strip or attached photo has not been addressed by any of the previous art.

Furthermore, storage of unit in a manner where it is not likely to be forgotten when going shopping has not been addressed by any of the prior art.

Customer Identification Cards:

In an attempt to secure and expand their customer base, many stores are implementing systems whereby the customer supplies some information, and they receive a store identification card which gives them certain discounts, and in some cases enters them in contests each time they use the card.

These programs attempt to accomplish several things:

1. The cards usually have the store name on them, thereby serving as advertising, reminding the customer of the store.
2. The cards track the spending habits of the customer, allowing for coupon mailings tailored to the customer.
3. The discounts and contests associated with the card help to keep the customers loyal, and causes them to shop at the store more often.
4. The cards help control check cashing privileges in some stores.

In order for the above to be accomplished, the cards must be carried by the customer. As more stores offer these cards, customers often decide they are carrying too many cards, and stop carrying store identification cards. They either stop using the cards all together, or carry them only when they are planning to go to the store which issued the card. In this second case, they often forget the card. The weakness of this system is a lack of sufficient motivation for the customer to carry or use the store identification card.

OBJECTS AND ADVANTAGES

One main object of the present invention is to provide an easy to produce and inexpensive to manufacture design for a bag carrier.

A further object of the present invention is to provide bag carriers which would be easy to produce and package with automated machinery.

A further object of the present invention is to provide bag carriers which could not hook each other or become tangled together.

A further object of the present invention is to minimize mold tooling costs.

A further object of the present invention is to require no moving parts or tight tolerances.

A further object of the present invention is to provide easy to package and ship bag carriers, for inexpensive distribution to retail outlets.

A further object of the present invention is to provide a means of carrying a bag without excessive discomfort.

A further object of the present invention is to provide a means of carrying several bags simultaneously without excessive discomfort, making it possible to carry several full bags with one hand.

A further object of the present invention is to provide an easy to use bag carrier.

A further object of the present invention is to make it possible to add or remove individual bags from the carrier without having to sort or untangle the handles of the individual bags.

A further object of the present invention is to make it possible to add or remove individual bags with only one hand, while holding the bag carrier with the other hand.

A further object of the present invention is to provide an easy to carry bag carrier, when it is not in use.

A further object of the present invention is to provide a light weight bag carrier.

A further object of the present invention is to provide a bag carrier which fits in a typical shirt pocket, pants pocket, or purse.

A further object of the present invention is to provide a bag carrier which will not easily tangle with purse or pocket contents.

A further object of the present invention is to provide an easy to store bag carrier for when it is not needed.

A further object of the present invention is to make it usable on a variety of bags and parcels, including bags with twine or tubular plastic handles, and packages wrapped with string or wire.

A further object of the present invention is to function as a promotional device by easily accepting indicia on one or more surfaces.

A further object of the present invention is to provide bag carriers with easy to reach areas for application of labels, decals, or silk screening in an automated or manual fashion.

A further object of the present invention is to provide a means for computer readable identification of user of the bag carrier for customer identification.

A further object of the present invention is to provide a means for signing the carrier for future use as verification of authorized user.

A further object of the invention is to include room for a photograph for future use as verification of authorized user.

Another main object of the invention is to improve upon the current card based identification system by placing the identifying function currently associated with cards onto an item useful to consumers in other ways besides serving as identification.

A further object of the invention is to improve upon the prior art by further encouraging the customer to carry and display an identifying device by offering further convenience and features on the device.

A further object of the invention is that it be more likely to be seen than the prior art identification cards, both by the consumer and by third parties, thereby increasing the advertising benefit.

A further object of the invention is that it be useful in some fashion outside of the store that issued it. Leading to even more exposure and greater customer good will.

Further objects and advantages of my invention will become apparent from a consideration of the drawings and ensuing description.

LIST OF REFERENCE NUMERALS

20. Label, Decal, or Silk-screening (printed indicia)
22. Barcode
24. Magnetic Strip
25. Signature Strip
26. Horizontal Upper Handle Section
28. Connecting Vertical Member
29. Connecting Vertical Member
30. Horizontal Lower Hook Support Section
31*a*. Hook Base
31*b*. Hook Base
31*c*. Hook Base
31*d*. Hook Base
32*a*. Hook Section
32*b*. Hook Section
32*c*. Hook Section
32*d*. Hook Section
34*b*. Vertical Hook Entrance Section
34*c*. Vertical Hook Entrance Section
34*d*. Vertical Hook Entrance Section
35*a*. Hook Pathway Constriction Section
35*b*. Hook Pathway Constriction Section
35*c*. Hook Pathway Constriction Section
35*d*. Hook Pathway Constriction Section
36*a*. Horizontal Hook Entrance Section
36*b*. Horizontal Hook Entrance Section
36*c*. Horizontal Hook Entrance Section
36*d*. Horizontal Hook Entrance Section
37*a*. Hook Captive Section
37*b*. Hook Captive Section
37*c*. Hook Captive Section
37*d*. Hook Captive Section
38. Lightening Pocket
39. Lightening Pocket
40*a*. Magnet
40*b*. Magnet
42. Inner Strengthening Rib
43. Inner Strengthening Rib
44. Outer Perimeter Strengthening Rib
46. Inner Perimeter Strengthening Rib
48. Strengthening Web
49. Strengthening Web
50. Finger Receiving Opening
52. Overhanging Hook Support Section
54. I.D. Photograph
55*a*. Suction Cup
55*b*. Suction Cup
56. Static Attraction Film
57. Computer Memory Device
58*a*. Adhesive Pad
58*b*. Adhesive Pad

SUMMARY

An easy to use and inexpensive to manufacture, package, and distribute bag carrier which can inexpensively incorporate indicia for advertising or other messages, as well as computer readable forms of identification and proof of authorized user means such as a signature strip or photograph.

DESCRIPTION OF INVENTION

Figure 1:
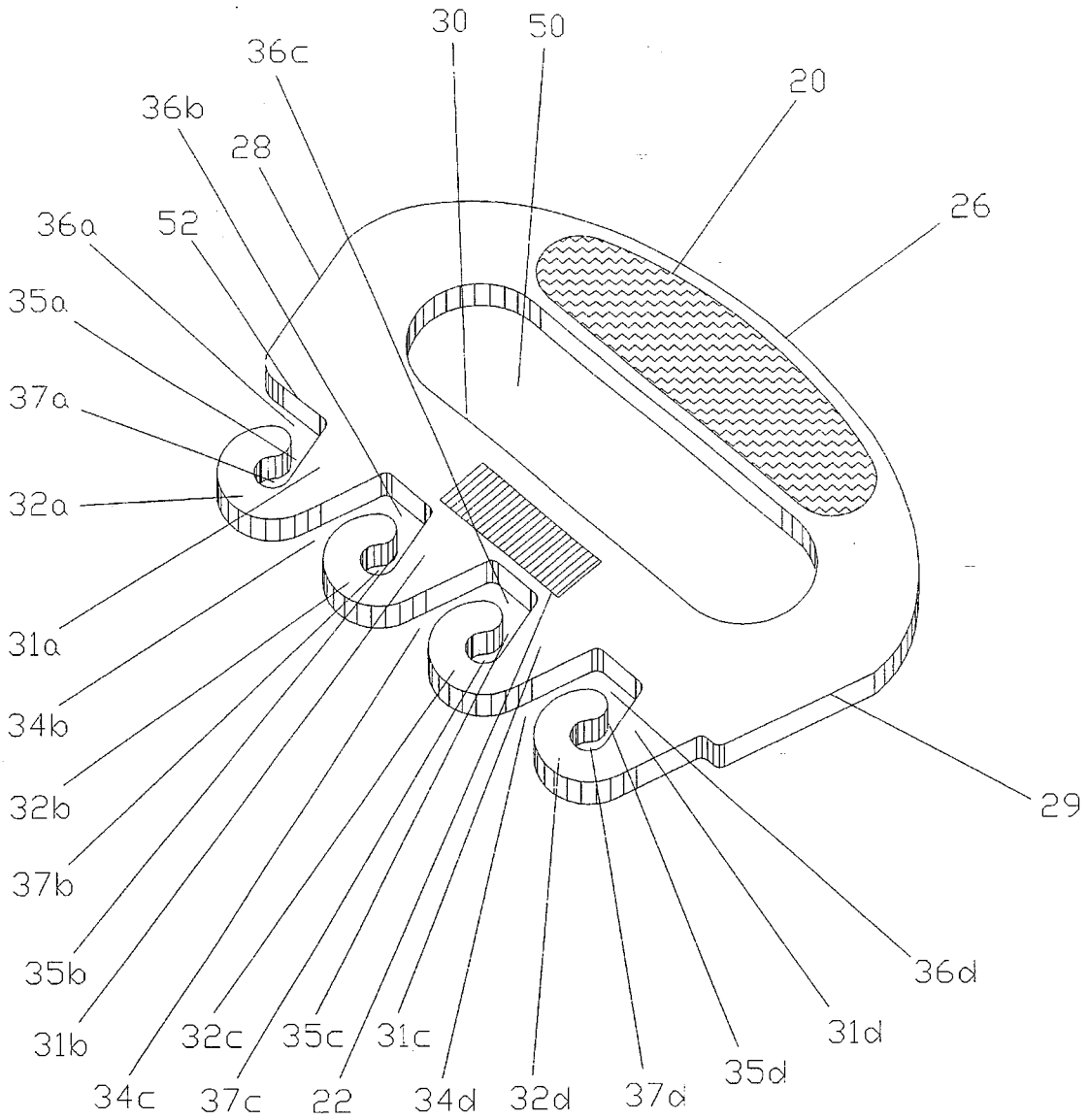
FIG. 1 is a perspective view of a preferred embodiment of the invention showing a label and bar code on the front, viewed from the front, right end, bottom.

FIG. 1 shows a perspective view of a preferred embodiment of my invention. The bag carrier includes a horizontal upper handle section 26 connected to a horizontal lower hook-support section 30 by connecting vertical members 28 and 29 at each end. Above sections and members combining to form perimeter of finger receiving opening 50.

A plurality of hook bases 31*a*, 31*b*, 31*c*, and 31*d* extend down from horizontal lower hook support section 30. Extending from the bottom of hook bases 31*a–d* and curving upward and towards the side of same hook base 31*a–d* are hook sections 32*a*, 32*b*, 32*c*, and 32*d*. Curvature of hook sections 32*a–d* are sufficient to form hook captive sections 37*a–d* and hook pathway constriction sections 35*a–d*.

Length of hook bases 31*a–d* and proximity of hook bases 31*a–d* to each other, combined with curvature and width of hook sections 32*a–d* allow space for vertical hook entrance sections 34*b–d* and horizontal hook entrance sections 36*a–d*.

Hook base 31*a* is far enough away from the left end of the bag carrier so no part of hook section 32*a* protrudes to the left of an imaginary line extending straight along the left end of the bag carrier along the outer edge of connecting vertical member 28 and continuing down past hook section 32*a*. An overhanging hook support section 52 exists from the left-most point of hook base 31*a* to the left end of horizontal lower hook support section 30.

Label, decal, silk-screening, or other forms of printed indicia 20 are on front of bag carrier on horizontal upper handle section 26. Barcode 22 is on front of bag carrier on horizontal lower hook support section 30.

Figure 2:
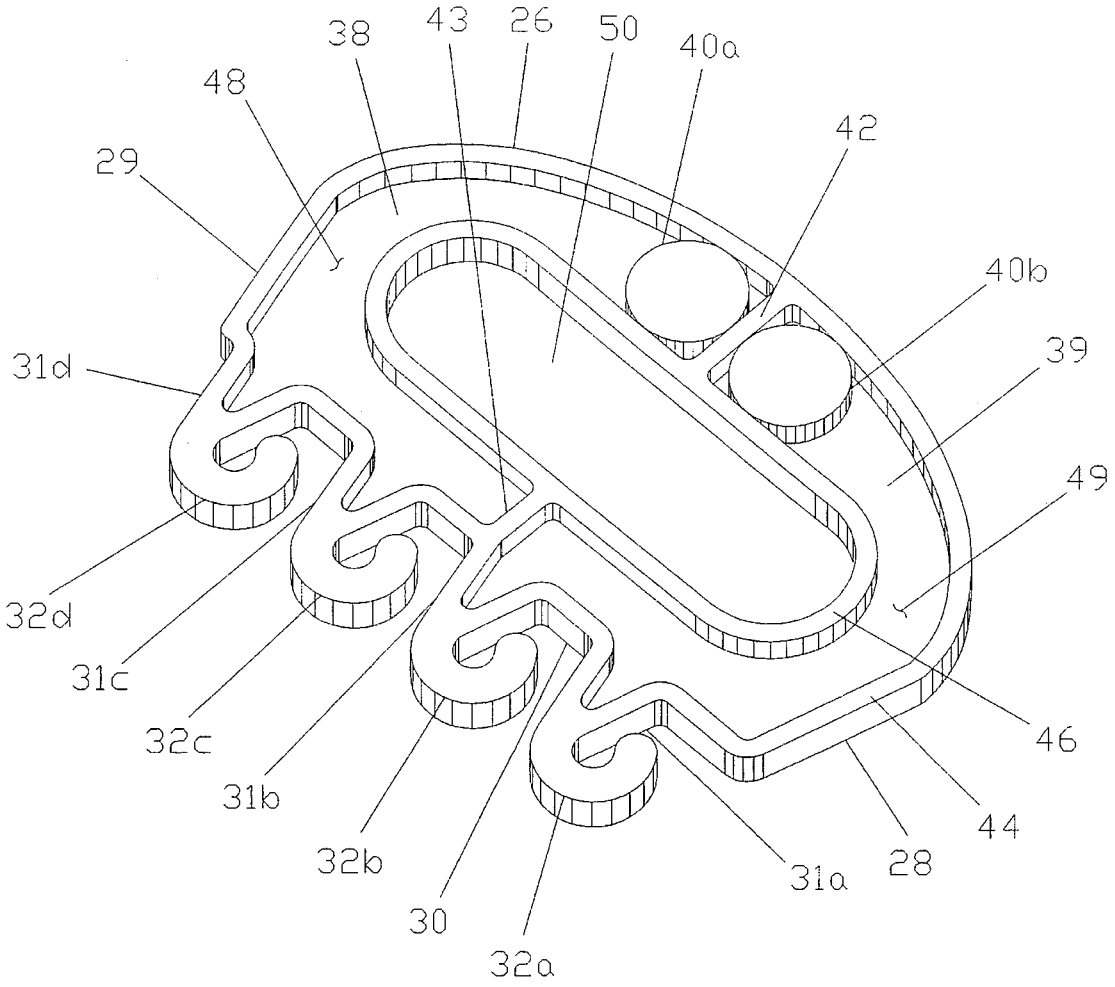
FIG. 2 is a perspective view of a preferred embodiment of the invention showing lightening pockets and magnets, viewed from the back, left end, bottom.

FIG. 2 shows a perspective view of the back of a preferred embodiment of my invention. Lightening pockets 38 and 39 extend across the majority of the back leaving full thickness of the carrier only in the hook sections 32*a–d*, the outer perimeter strengthening rib 44, the inner perimeter strengthening rib 46, and the inner strengthening ribs 42 and 43. Except for areas with lightening pockets, the bag carrier is of uniform thickness.

The outer perimeter strengthening rib 44 runs along the outer edge of the section consisting of horizontal upper handle section 26, Connecting Vertical Members 28 and 29, Horizontal Lower Hook Support Section 30, and hook bases 31*a*, 31*b*, 31*c*, and 31*d*.

Inner perimeter strengthening rib 46 runs along the edge of finger receiving opening 50.

Inner strengthening rib 42 connects the top center sections of outer perimeter strengthening rib 44 and inner perimeter strengthening rib 46.

Inner strengthening rib 43 connects the bottom center sections of outer perimeter strengthening rib 44 and inner perimeter strengthening rib 46.

Lightening pockets 38 and 39 do not extend completely through the bag carrier leaving strengthening webs 48 and 49 respectively.

Two magnets 40*a* and 40*b* are located on the back of horizontal upper handle section 26 mounted against strengthening web 48 and 49 respectively and between outer perimeter strengthening rib 44 and inner perimeter strengthening rib 46 on each side of inner strengthening rib 42. Magnets may be molded in place, bonded in place, snapped in place, held by mechanical fasteners, or by any other means commonly used to attach magnets. Back face of magnets 40*a* and 40*b* are substantially flush with the back face of strengthening ribs 42,43,44, and 46. Alternative devices and / or number of devices could be substituted for the magnets, including suction cups, static attraction materials, or sticky materials.

Figure 3:
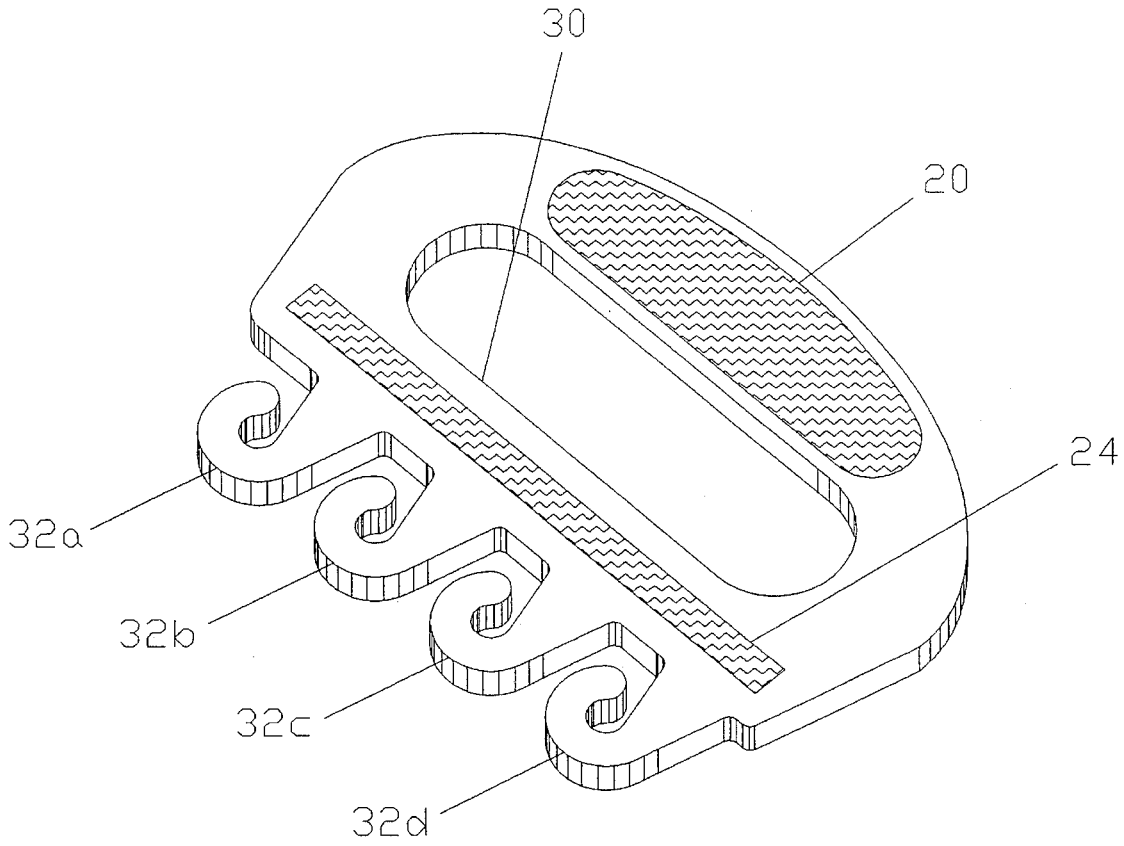
FIG. 3 is a perspective view of an embodiment of the invention showing a label and magnetic strip on the front, viewed from the front, right end, bottom.

FIG. 3 is an alternate embodiment in which magnetic strip 24 is on front of bag carrier on horizontal lower hook support section 30.

Figure 4:
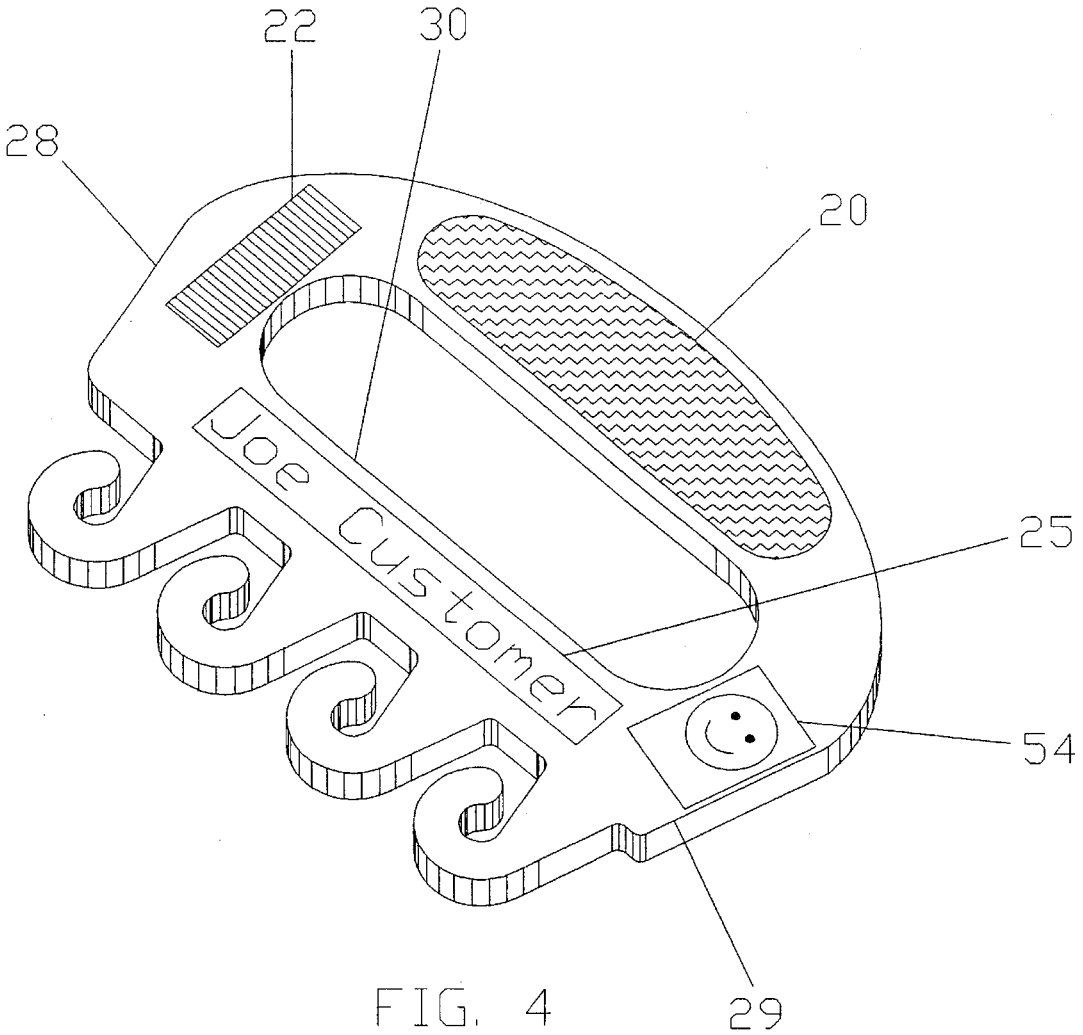
FIG. 4 is a perspective view of an embodiment of the invention showing a label, bar code, signature strip, and I.D. photo on the front, viewed from the front, right end, bottom.

FIG. 4 is an alternate embodiment in which signature strip 25 is on front of bag carrier on horizontal lower hook support section 30, barcode 22 is on connecting vertical member 28, and I.D. photograph 54 is on connecting vertical member 29.

Figure 5:
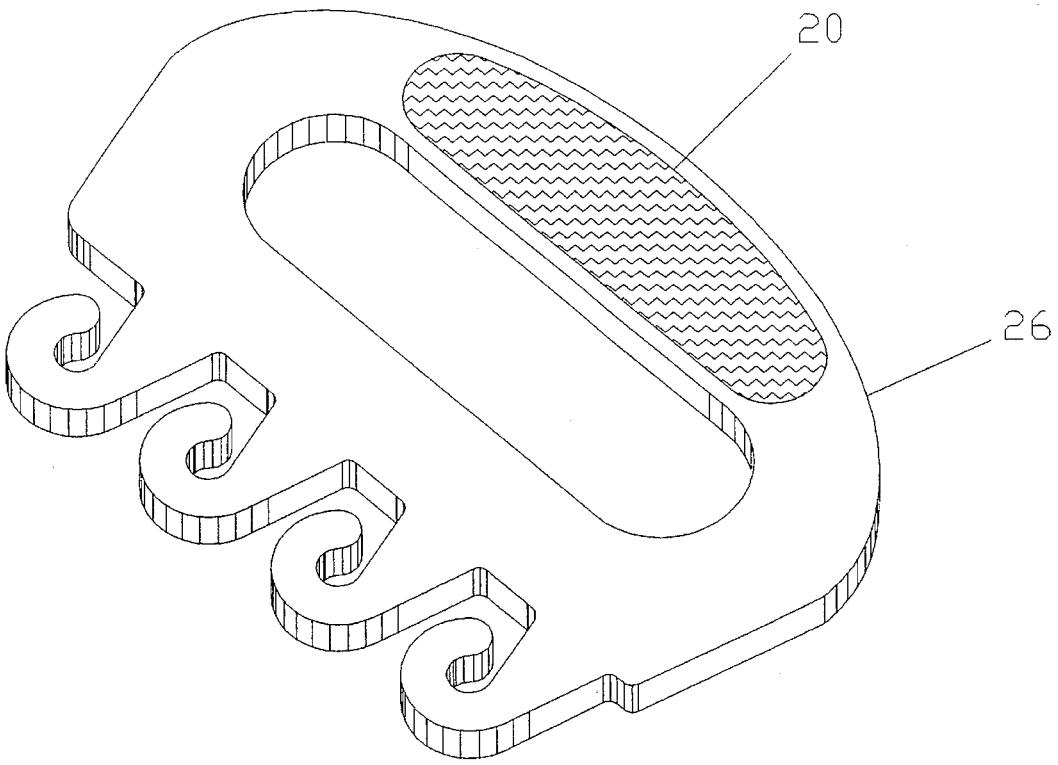
FIG. 5 is a perspective view of an embodiment of the invention showing a label on the front, viewed from the front, right end, bottom.

FIG. 5 is an alternate embodiment in which Label, decal, silk-screening, or other forms of printed indicia 20 are on front of bag carrier on horizontal upper handle section 26, with no form of individual identification applied.

Figure 6:
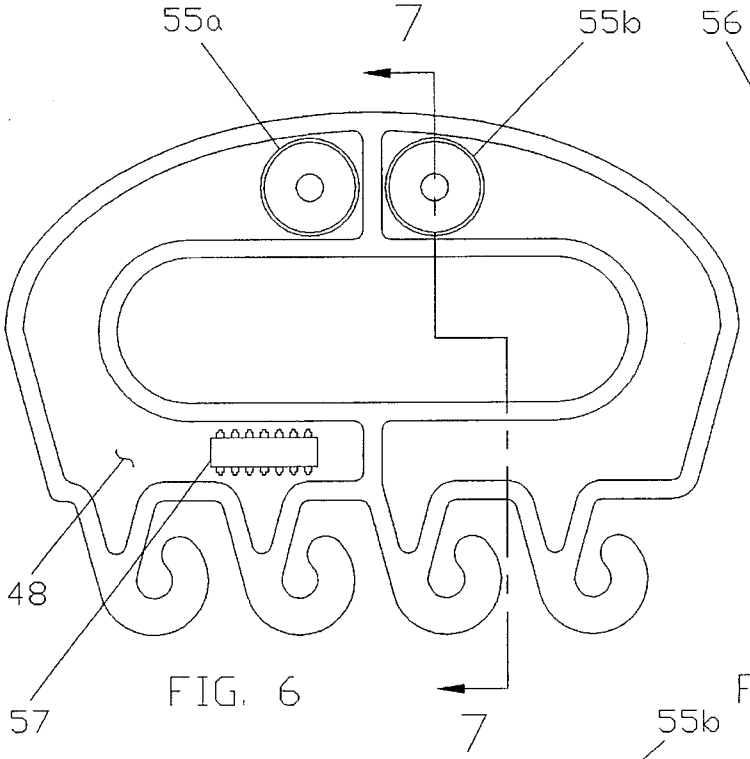
FIG. 6 is a rear elevational view of an embodiment of the invention showing suction cups and a computer memory device.

FIG. 6 is an alternate embodiment in which suction cups 55*a* and 55*b* are used in place of magnets 40*a* and 40*b*. Computer memory device 57 is located on the back of strengthening web 48.

Figure 7:
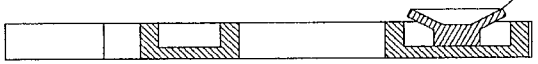
FIG. 7 is a cross-sectional view taken along line 7—7 shown in FIG. 6, showing a suction cup.

FIG. 7 is a cross-sectional view taken along line 7—7 shown in FIG. 6, showing suction cup 55*b*.

Figure 8:
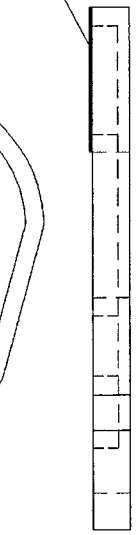
FIG. 8 is a left end elevational view of an embodiment of the invention showing static attraction film.

FIG. 8 is a left end elevational view of an embodiment of the invention showing static attraction film 56 used in place of magnets 40*a* and 40*b*.

Figure 9:
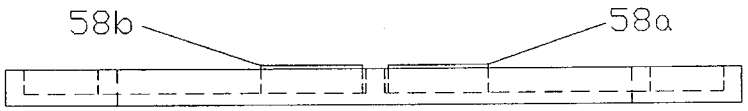
FIG. 9 is a top plan view of an embodiment of the invention showing adhesive pads.

FIG. 9 is a top plan view of an embodiment of the invention showing adhesive pads 58*a* and 58*b* used in place of magnets 40*a* and 40*b*.

Figure 10:
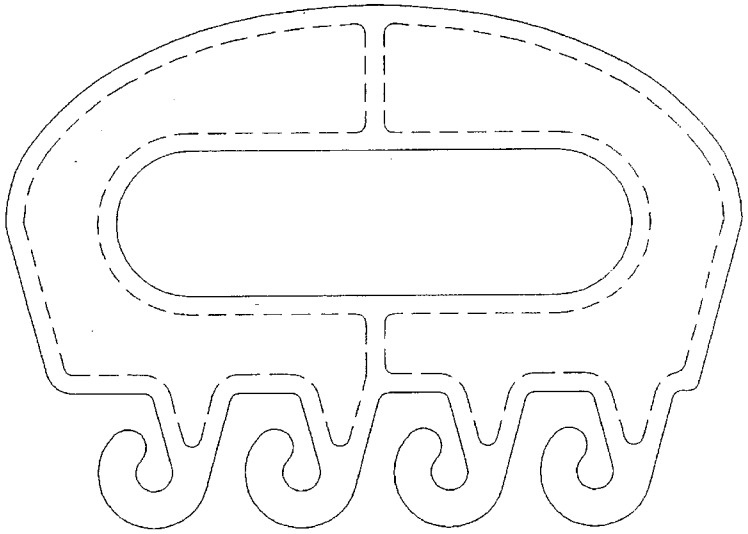
FIG. 10 is a front elevational view of an embodiment of the invention.

FIG. 10 is a front elevational view of an embodiment of the invention with no indicia or surface attraction means.

OPERATION OF INVENTION

This invention concerns two previously non-associated items. The combination of these two items makes them more valuable then the sum of their values when taken separately. The first item is a bag carrier for use with handled bags. The bag carrier described in this application is a significant improvement over the prior art, even without being combined with the second item. The second item is an identification card used by some stores to give customers discounts and track their spending habits. These cards generally have either a barcode, or a magnetic strip on them for scanning in the store, as well as written information and store logo and possibly a place for the customers signature and picture for future verification of authorized user. The invention also allows for easy application and display of advertising indicia.

To achieve the objectives of this invention, a bag carrier was needed which was inexpensive, comfortable and easy to use, could incorporate all the features of an identification card, and could readily accept advertising indicia.

FIG. 1 illustrates a preferred embodiment of the present invention designed to hold packages which have thin, built in handles, such as plastic grocery bags. The design allows bags to be easily hooked and unhooked, without the handles of the various bags getting tangled. The preferred configuration of the device includes four hook sections 32*a–d*, which allows up to four bags to be carried without tangling. More than one bag could be on each hook, but the potential for tangling bag handles is increased. More hooks could be used, but the device then gets inconveniently large, or the hooks get too small to use easily, as well as losing strength. The preferred configuration of the device will carry 10 pounds per hook, with a safety factor.

To make the bag carrier inexpensive, it was designed for easy automation of all phases of the product, with a minimum of tooling costs. This was achieved with the following parameters:

While many materials of sufficient strength could be used for this design, plastic was chosen due to the low cost, light weight, and case of molding a finished product without the need for secondary machining operations.

A main feature which minimizes costs throughout the production process is the flatness of the design.

Keeping the bag carrier flat and substantially flush on one side, with the flush side being parallel to the opposite side accomplishes several things:

By placing the strengthening webs 48 and 49 (FIG. 2) flush with the front of the bag carrier, and making the entire front flush, It is possible for one half of the mold to be essentially a flat plate, with no intricate machining, thus minimizing tooling costs. The part is also designed with no complex surfaces on the other side, or the need for any inserts, further minimizing tooling costs.

Additionally, when placed flush side up on a surface, the flush side is parallel to the surface in all directions allowing for easy application of indicia, whether labels, decals, silk screening or other form, in an automated fashion. In some alternate embodiments, it may be advisable to slightly raise or slightly depress any areas receiving indicia. Raised areas would be easier to silk screen, while depressed areas would protect the indicia.

Also, feeding parts into automated labeling or packing equipment using automated feeding systems is easier and less costly with flat parts, since the parts can be stacked in inexpensive hoppers.

Packing the parts into boxes is also less expensive, since the parts can be packed against each other like slices in a loaf of bread, without the need for spacers or partitions in the boxes. This saves the cost of partitions, as well as allowing a very tight packing density, saving in storage and shipping costs.

Another feature which minimizes production costs by allowing for easier automation is that the bag carriers are designed so they can not hook each other when placed randomly in a bin or hopper. This reduces the cost of manufacturing, since parts can be automatically fed from centrifugal or vibratory bowls without any concern of parts being tangled together and requiring operator intervention or higher levels of automation to untangle them. This is accomplished by keeping vertical hook entrance sections 34*b–d*, hook pathway constriction sections 35*a–d*, and horizontal hook entrance sections 36*a–d* narrower than the width of the device or hook sections 32*a–d*.

Another feature which minimizes production costs by allowing for quicker cycle times and less material are the lightening pockets 38 and 39 (FIG. 2) located on the back of the unit.

Tooling costs were further minimized by having a design with no critical dimensions. Prior art designs which have moving parts or constrictive passages require more accurate machining tolerances in the mold, closer attention to mold wear, and higher mold maintenance costs.

Comfort has been over-stressed in previous designs, at the expense of the other requirements of a bag carrier. Since the main purpose of the bag carrier is for limited length trips, a simple design which distributes the load from the bag handles, which often become wire-thin under load, to a less flexible, broader surface is sufficient. For the intended use of the product, contoured or cushioned handles are an unnecessary and costly expense. Therefore, the preferred embodiment of the present invention uses a simple surface along the top of finger receiving opening 50 (FIG. 1) of sufficient width and length to allow enough surface area to prevent undue discomfort in the hand and fingers of the person carrying a bag or bags over a short distance, such as from their car to their kitchen.

The distribution of hook sections 32*a–d* (FIG. 1) in the preferred embodiment allows for different quantities of bags to be carried, without causing all the weight to be transferred to the front or back of the carrier, which would unduly stress the front or back finger, or the wrist, of the person carrying the load.

Ease of use involves several different areas, including: The range of bag types the carrier will work with, the connection of individual bags onto the carrier, the removal of individual bags from the carrier, the ease of setting down and picking up the carrier when it is holding bags, the ease of carrying the carrier while shopping but before it is needed, the ease of storing the carrier, and the ease of remembering to take the carrier from storage when it is needed.

The first four areas above are a function of the hook sections 32*a–d* (FIG. 1) and surrounding components.

The hook sections 32*a–d* are designed to allow easy hooking and unhooking of individual bags, while minimizing the chances of a bag falling off. This is accomplished by having multiple hooks, and a smooth path leading into and out of each hook. The path is a short, flattened spiral, as described below. A typical path into a hook section can be seen in FIG. 1. To connect a bag to hook section 32*b*, the bag handles must first be moved up vertical hook entrance section 34*b*, which is bounded on the left side by the right outer edge of hook section 32*a* and hook base 31*a*, and bounded on the right side by the left outer edge of hook section 32*b*. Note that bag handles are guided to the entrance of this first section due to the curved outer edges of the adjacent hook sections 32*a* and 32*b*, which form a two dimensional funnel, making it very easy to get the bag handles into vertical hook section 32*b*. Next the bag handles must move to the right in horizontal hook entrance section 36*b*, which is bounded on the top by the lower edge of horizontal lower hook support section 30, and bounded on the bottom by the free end of hook section 32*b*. After that the bag handles must move down through hook pathway constriction section 35*b*, which is bounded on the left side by the free end of hook section 32*b*, and bounded on the right side by hook base 31*b*. Finally the bag handles are moved down into hook captive section 37*b*, which is bounded by the inner edge of hook section 32*b*and the left edge of hook base 31*b*. Keeping the bag handles against the outside wall of the spiral as they are being loaded or unloaded forces them into or out of the hooks respectively.

Normal loading or unloading is accomplished with one hand holding the device by horizontal upper handle section 26, while the other hand loads or unloads the individual bags. No moving parts are needed to secure bags and the bag handles do not have to be forced through a snap fit captive opening.

Some prior art carriers only have one pathway for all the handles, making it difficult to keep the bags from tangling with each other. By loading only one bag on each hook, it is easy to keep bag handles from becoming tangled with each other. Keeping the handles from tangling allows for easier unloading of bags. If the user has to carry more bags than the number of hooks on the carrier, they can always put more than one bag per hook, at the risk of tangling bag handles.

While not essential, all hook sections 32*a–d* are similarly shaped and oriented in the same direction so the same motion works to load bags on any of the hooks.

By utilizing a pathway requiring direction changes to unload a bag, the likelihood of a bag becoming unhooked when the carrier is set down is low. By making all direction changes in the same direction, the pathway does not hinder the user of the device from loading or unloading bags.

A snap fit captive opening system, as used in some prior art bag carriers, would have to be designed for a certain handle width. Smaller handles would not be held in, and larger handles could not be loaded onto the carrier.

Prior art systems using one way openings are difficult to unload.

Prior art systems requiring activation of a locking mechanism require an extra step on the part of the user.

By utilizing the flattened spiral pathway instead of any of the above prior art systems for retaining bags, the present invention will work with many different types of bags and packages, including twine handles and boxes wrapped with string or wire. No moving parts or tight tolerances are needed, and the user does not have to force or lock anything.

The fifth area, ease of carrying the unit while shopping but before it is needed, is a function of overall design and size.

The device is designed to be small enough to fit in most purses, pants pockets, or shirt front pockets. Since the device is flat and thin, it does not create discomfort even when placed in most pants back pockets. The hooks are recessed to minimize accidental snagging of contents of purses or pockets. It is not possible to accidentally hook an object without at least one change of direction of motion of either the bag carrier or the object being hooked. As can be seen in FIG. 1, relative to the bag carrier, objects being hooked must travel up, right and down to be hooked by any but the first hook section 32*a*. The first hook section 32*a* does not require the up step, but it still requires motion to the right and down. Overhanging Hook Support Section 52 is included to insure the need for two motions by the front hook.

The last two areas, ease of storing and ease of remembering the carrier, are also a function of design and size, with a specific feature discussed below which greatly enhances the product's performance in those areas.

None of the prior art has addressed how to store the unit when not needed. Most prior art, as well as the current invention will fit in a drawer in the kitchen. However, it is likely to be forgotten when going shopping.

Due to the small, thin, flat, light-weight, and non-snagging nature of the present invention, it could be left in the purse of the user, so it would be available whenever needed.

A significant improvement over the prior art is that the present invention includes magnets 40*a* and 40*b* (FIG. 2), suction cups 55*a* and 55*b* (FIG. 6), static attraction film 56 (FIG. 8), adhesive pads 58*a* and 58*b* (FIG. 9) or other means which allow it to remain on a non-horizontal surface, such as a refrigerator door through magnetic force, pressure differential force, electrostatic force or bonding force respectively. One of the greatest needs for the present invention is for carrying grocery bags. When people go grocery shopping, one of the first and last places they go is their refrigerator. They go there prior to leaving so they can see what they need to buy, and they go there after returning to store any items they bought requiring refrigeration. The outside surface of the refrigerator door is an ideal spot to store the bag carrier, since it is less likely to be forgotten when in such a highly visible spot, and it is also the start and end point of where it is needed for a given trip to the grocery store. Additionally, any promotional label, decal, or silk-screening 20 on the unit will be seen frequently by the occupants of the dwelling, significantly increasing the benefits to the advertiser.

Incorporating the necessary items of I.D. cards into a bag carrier necessitated two requirements in the invention to be practical, and several less critical requirements. One requirement is that the bag carrier have sufficient surface area to accommodate identification related items, such as barcode 22 (FIG. 1) or magnetic strip 24 (FIG. 3) or computer memory device 57 (FIG. 6), signature strip 25 (FIG. 4), and I.D. photograph 54 (FIG. 4) of user. A second requirement of the bag carrier is that the identification items can be easily and inexpensively applied.

To meet these requirements, the bag carrier is substantially flat. If the bag carrier is to feed through a magnetic card reader, this is very important. For items with bar codes, it is less important, but still advantageous, since it allows for easier application of identification related items and advertising information through silk screening or application of decals. Additionally, there are places on the bag carrier where a barcode is unlikely to be rubbed off or smudged, such as Horizontal Lower Hook Support Section 30 (FIG. 1), which tends not to be held while bags are being carried.

To accommodate a magnetic strip 24 (FIG. 3), the bag carrier is designed so it is stable when pulled through a magnetic card reader, thereby keeping the magnetic strip parallel to the direction of motion of the bag carrier thru the reader. This is accomplished as shown in FIG. 3, where the magnetic strip 24 is parallel to the bottom of the hook sections 32*a–d*, which act as a stable edge. This allows the bag carrier to be pulled through a magnetic card reader in a stable manner, since the bottom of the hooks act as the straight edge needed parallel to the magnetic strip. This keeps the magnetic strip properly oriented and aligned with the read head in the magnetic card reader.

In carriers utilizing both a barcode and a magnetic strip, the position of the magnetic strip is more important than the position of the barcode, so the magnetic strip is positioned as required, and the barcode is placed wherever it will fit, in any orientation. A typical alternative position for barcode 22 can be seen in FIG. 4, where barcode 22 is located on connecting vertical member 28.

The thickness of the bag carrier is small compared to height or width. The ratio of height to thickness is over ten to one in the preferred embodiment. This aids in use with a magnetic card reader, and allows for easier application of identification related items and advertising information.

Less critical items are for customer convenience and include items previously discussed as important for a bag carrier.

In addition to identification related items, there is room on the bag carrier for retailer advertising, such as corporate name and address. Typical label, decal or silk-screening 20 can be seen in FIG. 1,3,4, and 5. This invention exposes the consumer to that advertising more often than they would be exposed to similar advertising or logos on card based identification systems. Cards are usually stored in the wallet where they are only partially visible. With this invention, the bag carrier is left more exposed, such as loose in the purse, or on a refrigerator door. Where it will be seen often, even when not being used. The same design features of the bag carrier that allow for easy application of identification related items allow for easy application of advertising indicia.

In an attempt to secure and expand their customer base, many stores are implementing systems whereby the customer supplies some information, and they receive a store identification card which gives them certain discounts, and in some cases enters them in contests each time they use the card. Some stores offer cards for free, others require a one time or annual membership fee.

These programs attempt to accomplish several things:

1. The cards usually have the store name on them, thereby serving as advertising, reminding the customer of the store.
2. The cards track the spending habits of the customer, allowing for coupon mailings tailored to the customer.
3. The discounts and contests associated with the card help to keep the customers loyal, and causes them to shop at the store more often.
4. The cards help control check cashing privileges in some stores.

In order for the above to be accomplished, the cards must be carried by the customer. As more stores offer these cards, customers often decide they are carrying too many cards, and stop carrying store identification cards. They either stop using the cards all together, or carry them only when they are planning to go to the store which issued the card. In this second case, they often forget the card. The weakness of this system is a lack of sufficient motivation for the customer to carry or use the store identification card.

The current invention improves upon the card based identification system by giving the consumer an added incentive, (ease of carrying bags), to carry the device, not only when shopping at the store which issued the card, but at other stores as well. The current invention also improves upon the prior art by serving as a reminder it is needed when the consumer stores it on the refrigerator door.

The current invention benefits the store which issues it because the advertising is seen whenever the item is used, even when used at other stores. When not used, it is more visible in the purse or on the refrigerator than standard cards, so the customer will see store advertising more frequently. It also generates goodwill for the store because even when customers use the item in other stores, they are reminded of where they received it, and realize their fingers don't hurt as much due to the store that gave them the device.

Full assembly and implementation of this invention is not required at the factory, and in some instances is better accomplished at point of distribution. Computer readable identification of user, such as barcode 22 (FIG. 1) and magnetic strip 24 (FIG. 3), is easy to apply at either the factory or point of distribution.

When the bag carrier is not intended for use as an identification device, it is most efficient to apply the printed indicia 20 as the carriers are produced. Since all carriers could have the same printed indicia 20, there is no need to keep track of individual units. Bag carriers can be mailed directly to customers, or given out in the stores, possibly controlled with the use of coupons mailed to the neighborhoods surrounding a store, or coupons sent to established customers. The bag carrier could also be sold to customers through normal channels.

When customers already have barcode card based systems in a given store, the store could mail a personal barcode sticker to the customer, possibly along with, or even attached to, a coupon good for a bag carrier. Bag carriers could then be handed out or sold in the store, and the customer or a store employee would apply the sticker.

Alternatively, bag carriers could come with barcodes 22 (FIG. 1) already applied and customer information could be linked to a given barcode, either before the carrier is mailed to the customer, or at the store when the bag carriers are distributed. This would be easiest in cases where customers do not already have identification cards.

In most cases, stores which currently have bar coded customer cards will not have to modify their equipment to work with bar coded bag carriers.

When a store uses magnetic strip based systems, the strips are best applied at the factory for accuracy and to avoid damaging the magnetic strip.

In cases where customers already have cards, the bag carrier with a blank magnetic strip could be picked up by the customer in the store. The customer's old card would then be scanned through a card reader, and the information from that card would be held in computer memory temporarily. The bag carrier would then be pulled through a unit which would write the stored information on the magnetic strip of the bag carrier.

Alternatively, bag carriers could come with programed magnetic strips already on them and customer information would be linked to the magnetic strip information, either before the bag carrier is mailed out, or at the store when the bag carrier is picked up. This may be best in cases where customers do not already have cards.

In most cases, stores which currently have magnetic strip coded customer cards will have to modify their equipment to work with magnetic strip bag carriers. Magnetic card readers will have to be modified from current "Credit Card" thickness slots, to wider or adjustable, (possibly spring loaded), slots to accept the bag carriers, which are thicker than standard credit cards. They may also need adjustable height reading heads, or several reading heads, to accommodate the bag carriers as well as standard magnetic cards. Other than these physical changes, no change to the method of reading or writing information on the magnetic strip is necessary. Standard techniques commonly known by persons practiced in the art could be utilized.

CONCLUSION, RAMIFICATIONS, AND SCOPE OF INVENTION

As can be seen by the descriptions and figures, the bag carrier meets all the suggested parameters mentioned in a previous sections. It is easy to use, inexpensive to produce and distribute, and readily accepts advertising indicia and customer identification information.

While my above description contains many specificities, these should not be construed as limitations on the scope of the invention, but rather as an exemplification of one preferred embodiment thereof. Many other variations are possible. For example, labeling and indicia are not limited to areas shown or label shapes shown. Units could have more hooks, or less hooks. Bag carriers could have no indicia at all. Also many combinations of labeling, computer readable codes, signature strips, and other identification means are possible, such as a barcode and magnetic strip with identification photograph and advertising. Accordingly, the scope of the invention should be determined not by the embodiments illustrated, but by the appended claims and their legal equivalents.

I claim:

1. A bag carrier a comprising:

a horizontal upper handle section having two ends;

a horizontal lower hook support section having two ends;

two substantially vertical connecting member joining the ends of said horizontal upper handle section to the two ends of said horizontal lower hook support section;

a finger receiving opening located in an area between said vertical connecting members, said horizontal upper handle section and said horizontal lower hook support section;

a plurality of hook bases extending down from said horizontal lower hook support section;

a plurality of hook sections extending from the bottom of said hook bases each of said hook sections having an individual flat path including a tapered entrance extending upward and tapering to a width less than the thickness of said bag carrier and dedicated to a single hook, said path extending sideways to a horizontal hook entrance section from said tapered entrance and then downward past a hook pathway constriction section to a hook captive section and said bag carrier being generally flat and having a substantially flat area on one side.

2. The bag carrier of claim 1, further including lightening pockets on one side thereof, whereby weight, cost of material, and production cycle time is reduced.

3. The bag carrier of claim 1 which further includes an identification device mounted thereon which contains computer readable identification information.

4. The bag carrier of claim 3 wherein said identification device is a barcode.

5. The bag carrier of claim 3 wherein said identification device is a magnetic strip.

6. The bag carrier of claim 3 wherein said identification device is a computer chip.

7. The bag carrier of claim 1 which further includes an identification device mounted thereon in the form of a signature strip.

8. The bag carrier of claim 1 which further includes an identification device mounted thereon in the form of a photograph.

9. The bag carrier of claim 1 which further includes printed indicia carried on said flat surface.

10. The bag carrier of claim 1 which further includes an attaching device carried thereon.

11. The bag carrier of claim 10 wherein said attaching device is a magnet.

12. The bag carrier of claim 10 wherein said attaching device is a suction cup.

13. The bag carrier of claim 10 wherein said attaching device is a static electricity force, causing adherence due to electrostatic force.

14. The bag carrier of claim 10 wherein said attaching device is an adhesive layer causing adherence due to bonding force.

15. The bag carrier of claim 10 which further includes an identification device mounted thereon.

* * * * *